United States Patent [19]

Barker

[11] 4,154,979

[45] May 15, 1979

[54] WOOFER EFFICIENCY

[75] Inventor: Charles R. Barker, Harvard, Mass.

[73] Assignee: Bose Corporation, Framingham, Mass.

[21] Appl. No.: 812,492

[22] Filed: Jul. 5, 1977

[51] Int. Cl.[2] ..... H04R 1/28
[52] U.S. Cl. ..... 179/1 E
[58] Field of Search ..... 179/1 E, 1 D

[56] References Cited

U.S. PATENT DOCUMENTS 3,130,374 4/1964 Beres et al. ..... 179/1 D

OTHER PUBLICATIONS

Olson, "Acoustical Engineering," Van Nostrand, 1957, pp. 159–161.
Hirsch-Houck, "Electro-Voice Interface A Speaker System," Stereo Review, Mar., 1974.
R. Newman, "A Loudspeaker Design etc.," J. of Audio Eng. Soc., Jul.-Aug., 1973.

*Primary Examiner*—Kathleen H. Claffy
*Assistant Examiner*—E. S. Kemeny
*Attorney, Agent, or Firm*—Charles Hieken

[57] ABSTRACT

A louspeaker system having a woofer, tweeter and crossover network has a closed box resonance of 81.5 Hz which frequency is above the half-power point of 65 Hz of the system that includes active equalization of the vented box woofer in the region below 81.5 Hz with an inexpensive two-pole one-transistor circuit.

8 Claims, 5 Drawing Figures

WOOFER EFFICIENCY

BACKGROUND OF THE INVENTION

The present invention relates in general to improving woofer efficiency and more particularly concerns novel apparatus and techniques for providing an economical compact relatively efficient loudspeaker system with relatively good performance.

From the standpoint of achieving optimum sound reproduction, the best presently known approach is that of the BOSE 901 DIRECT/REFLECTING loudspeaker system generally of the type described in U.S. Pat. No. 3,582,553. That system uses a multiplicity of full-range drivers in combination with an electronic active equalizer having more than one hundred components. The use of multiple full-range speakers helps eliminate audible resonances and avoids the disadvantages associated with woofers, tweeters and crossovers. However, the use of so many loudspeakers and components in the equalizer is costly. The more economical approach is to use a woofer, tweeter and crossover network that directs low frequency signals to the woofer and high frequency signals to the tweeter in a vented box. A typical approach is to design for a Butterworth Response characteristic in the manner described in a paper by A. N. Thiele entitled "Loudspeakers in Vented Boxes" in the May and June 1971 issues of JOURNAL OF THE AUDIO ENGINEERING SOCIETY, pp. 382–91 and 471–83. Specific loudspeaker systems using these principles are described in papers by Raymond J. Newman entitled "A Loudspeaker System Design Utilizing a Sixth-Order Butterworth Response Characteristic" in the JOURNAL OF THE AUDIO ENGINEERING SOCIETY, July/August 1973, pp. 450–56, and D. B. Keele, Jr., entitled "A New Set of Sixth-Order Vented-Box Loudspeaker System Alignments" in the JOURNAL OF THE AUDIO ENGINEERING SOCIETY, June 1975, pp. 354–60. These papers teach establishing the closed box fundamental resonance of the woofer at a frequency corresponding to the half power point in a system consisting of the loudspeaker in its enclosure together with a complementary filter of the type described by Thiele as his alignment 15. Although this approach provides a reasonably uniform frequency response above the lower half power point, efficiency is less than would be desired.

Accordingly, it is an important object of this invention to provide a woofer-tweeter loudspeaker system with improved efficiency.

It is a further object of the invention to achieve the preceding object while providing a good low frequency response.

It is still a further object of the invention to achieve one or more of the preceding objects economically.

SUMMARY OF THE INVENTION

According to the invention, there is means including the woofer mass and cabinet compliance for establishing the closed box fundamental resonance of the woofer-tweeter loudspeaker system at a frequency higher than the lower half power point frequency of the system, and means for actively equalizing the woofer frequency response to establish a substantially uniform frequency response, such as 3 db between the lower half power point frequency of the system and at least a frequency above the fundamental closed box resonance of the system. The latter means preferably comprises a two-pole single-transistor circuit.

Numerous other features, objects and advantages of the invention will become apparent from the following specification when read in connection with the accompanying drawing in which:

DETAILED DESCRIPTION OF PREFERRED EMBODIMENTS

Figure 1:
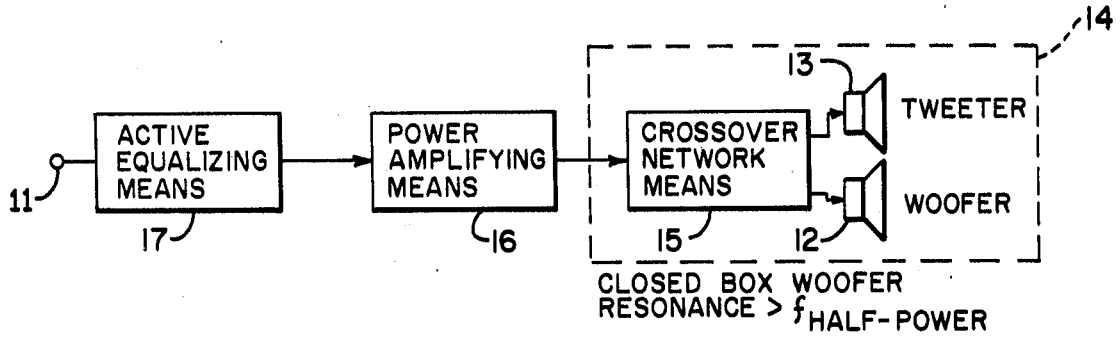
FIG. 1 is a block diagram illustrating the logical arrangement of a system according to the invention.

With reference now to the drawing and more particularly FIG. 1 thereof, there is shown a block diagram illustrating the logical arrangement of a system according to the invention. A signal on input terminal 11 is reproduced by woofer 12 and tweeter 13 in cabinet 14 energized through crossover network means 15 by power amplifying means 16. Active equalizing means 17 provides an equalized signal to power amplifying means 16 to compensate for the fall-off in response of woofer 12 from a frequency above the closed box woofer resonance. In a preferred exemplary embodiment the closed box fundamental resonance of the woofer is 81.5 Hz and the 3 db downpoint of the unequalized system is 65 Hz.

Figure 2:
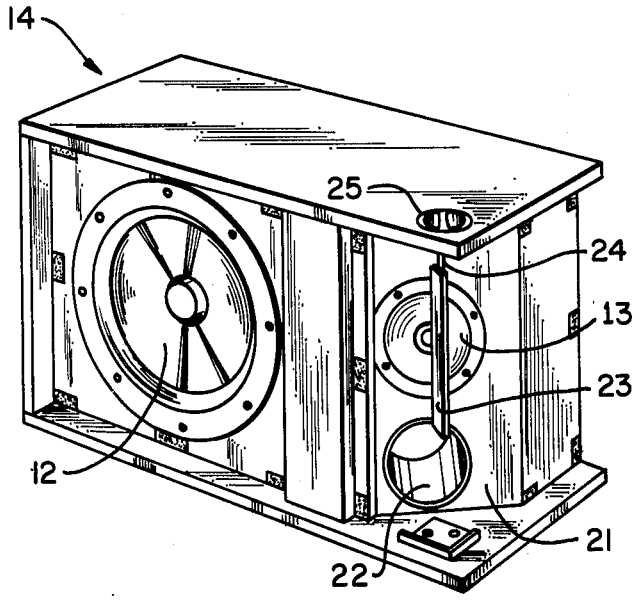
FIG. 2 is a perspective view of a preferred embodiment of the loudspeaker cabinet according to the invention.

Referring to FIG. 2, there is shown a perspective view of a preferred form of cabinet according to the invention corresponding substantially in structure to the commercially available BOSE Model 301 loudspeaker with the exception that the fundamental closed box resonance of the woofer has been raised from 79 Hz to 81.5 Hz by reducing the woofer mass, such as by using fewer voice coil turns. This reduction in turns and mass increases the B1 ratio and damping while facilitating equalization with a relatively inexpensive two-pole network. A conventional system with a 40 Hz half-power point would require about twice the cabinet volume to achieve the same damping and would have ¼ the midband efficiency.

Cabinet 14 supports woofer 12 in the front panel and tweeter 13 in the angled panel 21 that also carries vent tube 22. A sound deflecting vane 23 depends from shaft 24 suspended from knob 25 for controlling the effective directivity of the tweeter.

Figure 3:
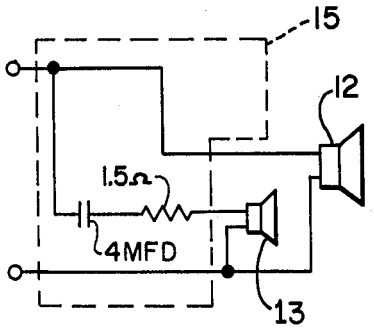
FIG. 3 illustrates a preferred form of crossover network.

Referring to FIG. 3, there is shown a schematic circuit diagram of a preferred form of crossover network means 15 with specific parameter values.

Figure 4:
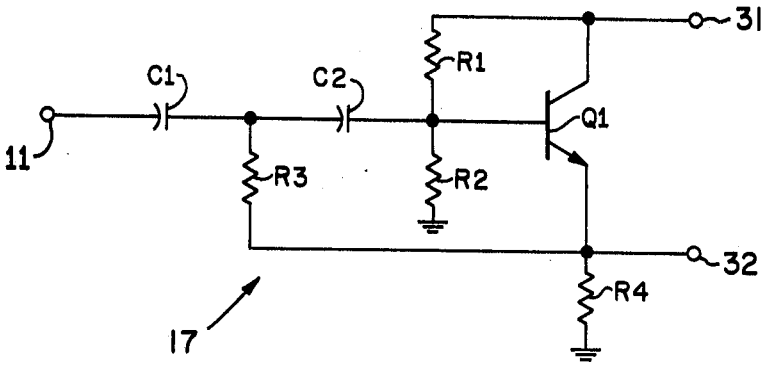
FIG. 4 is a schematic circuit diagram of a preferred form of active equalizer.

Referring to FIG. 4, there is shown a schematic circuit diagram of active equalizing means 17 which receives an input signal on terminal 11 and drives power amplifying means 16 between terminal 32 and ground. Terminal 31 receives collector potential for this two-pole emitter follower circuit. Typical parameter values are:

C1, C2: 0.022 μf

R1, R2: 3.3 Megohm
R3: 18 KΩ
R4: 47 KΩ
Q1: 2SC1335
C3, C4: 0.022 μf
R5, R6: 56 KΩ

Relative to the frequency response at 1 kHz, the circuit of FIG. 4 produces a response 10 db higher at 45 Hz so that the overall system response is within ±3 db from 40 Hz to a frequency above 100 Hz and falls off at 36 db per octave with the half power frequency being 42 Hz.

These parameters produce a peak at substantially 48 Hz which is substantially at the port resonance.

Figure 5:
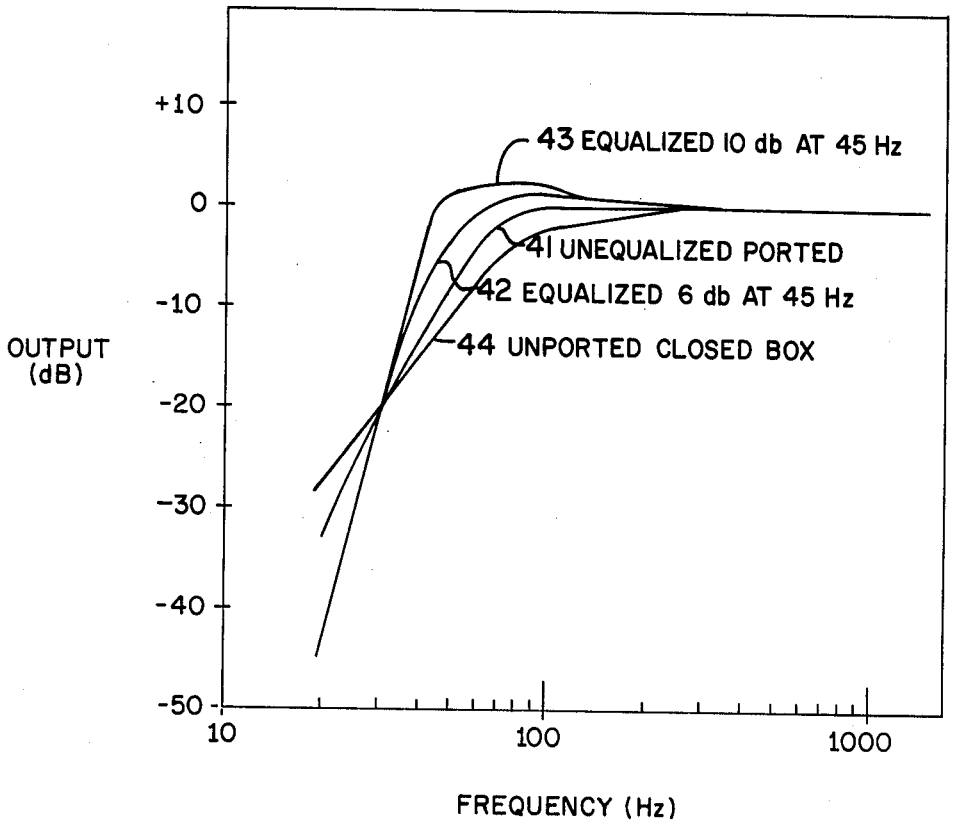
FIG. 5 is a graphical representation as a function of frequency showing the woofer frequency response as a function of frequency for a crossover network of FIG. 4 with no equalization, 6 db equalization at 45 Hz and 10 db equalization at 45 Hz.

Referring to FIG. 5, there is shown a graphical representation of the system response as a function of frequency without equalization represented by curve 41 showing the 3 db down point at 65 Hz, with 6 db equalization at 45 Hz represented by curve 42 and in a preferred form of the invention with 10 db equalization at 45 Hz represented by curve 43 resulting in the frequency response between 40 Hz and above 100 Hz being within ±3 db. Curve 44 shows the closed box unequalized response with port 22 covered.

The prior art approach exemplified by the aforesaid papers teaches establishing the closed box tuning frequency $F_b$ the same as the lower half power frequency $F_3$ of the system relative to its constant output region. In contrast it is an important feature of the present invention to select the closed box tuning frequency $F_b$ above the half-power frequency $F_3$ of the system relative to its constant output region and thereby effect a material increase in efficiency while using relatively inexpensive two-pole active equalization to retain an exceptionally good low frequency response for a system of this low cost and small size so that the invention may readily be used with a 10 watt power amplifier providing exceptionally high sound levels accurately reproducing relatively low bass tones.

In an actual embodiment of the invention, tweeter 11 was a 3 inch tweeter having a nominal voice coil impedance of 8 ohms, woofer 12 was an 8 inch woofer having a nominal impedance of 8 ohms, the volume of cabinet 14 was 0.7 feet$^3$ and vent tube 22 was 6 inches long and 2.5 inches in diameter.

There has been described novel apparatus and techniques for appreciably increasing efficiency of an economical compact woofer-tweeter loudspeaker system while providing exceptionally good bass response for such a compact inexpensive system. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a loudspeaker system having a woofer and at least one tweeter energized through a crossover network in a vented cabinet, the improvement comprising, means including the woofer mass and the compliance of said cabinet for establishing the closed box fundamental resonance of said woofer at least as high as of the order of 80 Hz and at least of the order of 20% higher than the half power frequency of said vented loudspeaker system relative to its constant output region, port means having a mass so that the port resonant frequency of the port means mass with the compliance of said cabinet is lower than the half power frequency of said vented loudspeaker system, input terminal means for receiving an input signal, active equalizing means for compensating for the fall-off in frequency response from a frequency just above said half-power frequency of said vented loudspeaker system to a predetermined frequency significantly below said half-power frequency so that the frequency response of the equalized loudspeaker system between said lower frequency and said frequency just above said half-power frequency of said vented loudspeaker system is substantially uniform while the efficiency of said system is significantly increased relative to the system with said closed box fundamental resonance of said woofer being the same as said half-power frequency, and means including said active equalizing means for coupling said input terminal means to said woofer and to said tweeter.

2. The improvement in accordance with claim 1 wherein said active equalizing means comprises a two-pole network.

3. The improvement in accordance with claim 2 wherein said two-pole network is a two-pole RC network.

4. The improvement in accordance with claim 3 wherein said network comprises a single transistor.

5. The improvement in accordance with claim 4 wherein said network comprises a transistor having at least a base, emitter and collector, input and common terminals, first and second output terminals connected to said collector and emitter respectively, an emitter resistor connected between the transistor emitter and said common terminal, a base resistor connected between the transistor base and said common terminal, first and second capacitors connected in series between said input terminal and the transistor base, and a third resistor connected between the junction of said first and second capacitors and said emitter.

6. The improvement in accordance with claim 1 wherein said means for establishing further includes means for providing sufficient damping so that said active equalizing means may provide effective compensation for said fall-off in frequency response with a two-pole network and said active equalizing means comprises a two-pole network.

7. The improvement in accordance with claim 1 wherein said means for establishing comprises the mass of said woofer being below that of a woofer in a vented cabinet of the same volume with the closed box fundamental resonance of the latter woofer being substantially the same as said half-power frequency.

8. The improvement in accordance with claim 1 wherein said active equalizing means is characterized by a peak substantially at said port resonant frequency.

* * * * *